US011848498B2

(12) United States Patent
Ahlström et al.

(10) Patent No.: US 11,848,498 B2
(45) Date of Patent: Dec. 19, 2023

(54) FILTER ARRANGEMENT AND ANTENNA FEEDING NETWORK FOR A MULTI RADIATOR ANTENNA HAVING SUCH A FILTER ARRANGEMENT

(71) Applicant: Cellmax Technologies AB, Kista (SE)

(72) Inventors: Alf Ahlström, Spånga (SE); Anders Edquist, Täby (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 59 days.

(21) Appl. No.: 17/712,422

(22) Filed: Apr. 4, 2022

(65) Prior Publication Data

US 2023/0318201 A1 Oct. 5, 2023

(51) Int. Cl.

| | |
|---|---|
| ***H01P 1/20*** | (2006.01) |
| ***H01Q 21/00*** | (2006.01) |
| ***H01P 1/202*** | (2006.01) |
| ***H01P 7/00*** | (2006.01) |

(52) U.S. Cl.

CPC ..... *H01Q 21/0006* (2013.01); *H01P 1/20* (2013.01); *H01P 1/202* (2013.01); *H01P 7/005* (2013.01)

(58) Field of Classification Search

CPC .. H01P 1/20; H01P 1/202; H01P 1/201; H01P 1/205; H01P 1/2053; H01P 1/207; H01P 1/208; H01P 7/00; H01P 7/005; H01P 7/04; H01P 7/06; H03H 7/0115; H03H 7/01; H03H 7/0138; H03H 7/1766; H03H 7/1775; H03H 7/1783; H03H 7/1791; H01Q 21/006

See application file for complete search history.

(56) References Cited

U.S. PATENT DOCUMENTS

| | | | | | |
|---|---|---|---|---|---|
| 3,836,881 | A * | 9/1974 | Koizumi | H01P 1/205 | 336/131 |
| 4,052,684 | A * | 10/1977 | Schmalz | H01P 7/005 | 333/226 |
| 5,159,303 | A * | 10/1992 | Flink | H01P 7/005 | 333/234 |
| 5,570,071 | A * | 10/1996 | Ervasti | H01P 7/005 | 333/202 |
| 2003/0001697 | A1 | 1/2003 | Bennett | | |
| 2019/0051960 | A1 | 2/2019 | Karlsson | | |

* cited by examiner

*Primary Examiner* — Stephen E. Jones
(74) *Attorney, Agent, or Firm* — The Jansson Firm; Pehr B. Jansson

(57) ABSTRACT

Filter arrangement comprising an inner electric conductor comprising at least one inner conductor segment, an outer electric conductor at least partly surrounding the inner conductor, at least one dielectric element and at least one coil spring. The at least one dielectric element is arranged sandwiched between at least one inner conductor segment and the outer conductor to form a capacitance between the outer conductor and the inner conductor segment. The at least one coil spring is arranged inside said outer conductor to force the inner conductor segment and the at least one dielectric element against the outer conductor. The at least one coil spring is made from an electrically conducting material to form an inductance and is electrically connected with the inner conductor segment. An antenna feeding network and a multi-radiator antenna comprising such a filter arrangement is also provided.

21 Claims, 3 Drawing Sheets

FILTER ARRANGEMENT AND ANTENNA FEEDING NETWORK FOR A MULTI RADIATOR ANTENNA HAVING SUCH A FILTER ARRANGEMENT

TECHNICAL FIELD

The invention relates to filter arrangements for RF applications. More specifically, the invention relates to filter arrangements for multi radiator base station antennas.

BACKGROUND

Filter arrangements for RF applications are known in the art. Such filter arrangements include low pass filters used in base station antennas for mobile communication. Such an antenna may comprise a connector through which not only the RF signal, but also a DC voltage and a communication signal for ancillary devices such as a RET (Remote Electrical Tilt) motor is provided. A low pass filter is used to filter out or block the RF signal to provide the DC voltage and communication signal for the ancillary device. In such a case the communication may be modulated on a carrier as defined in, e.g., 3GPP specification TS 25.461.

U.S. Patent Publication US2003/0001697 discloses a known low pass filter having a circuit (FIG. 1A in US2003/0001697) consisting of a series of inductors alternating with shunt capacitors realized as a coaxial transmission line (FIG. 1B) that includes an outer conductor and an inner conductor structure separated from one another by a dielectric. The inner conductor structure includes short high-impedance conductor sections (inductances) and in-between these low-impedance disks (capacitances). In antenna applications as described above, a quite low cut-off frequency is required which means that both the inductors and capacitors need to be large. High inductance may be achieved by replacing the high-impedance sections in US2003/0001697 with coils. High capacitance however requires a very thin dielectric film, which means that mechanical tolerances must be very tight. This requirement causes production to be difficult and expensive.

Thus, there is a need for an improved filter arrangement.

SUMMARY

An object of the invention is to solve or improve on at least some of the problems mentioned above in the background section.

These and other objects are achieved by the present invention by means of a filter arrangement according to the independent claim.

According to a first aspect of the invention there is provided a filter arrangement comprising an inner electric conductor comprising at least one inner conductor segment, an outer electric conductor at least partly surrounding the inner conductor, at least one dielectric element and at least one coil spring. The at least one dielectric element is arranged sandwiched between at least one inner conductor segment and the outer conductor to form a capacitance between the outer conductor and the inner conductor segment. The at least one coil spring is arranged inside said outer conductor to force the inner conductor segment and the at least one dielectric element against the outer conductor. The at least one coil spring is made from an electrically conducting material to form an inductance and is electrically connected with the inner conductor segment.

In other words, the inner electric conductor and the at least one dielectric element are surrounded at least partly by the outer conductor in the sense that the inner electric conductor and the at least one dielectric element are at least partly arranged inside the outer conductor. At least partly should be interpreted in the sense that one or more portions of the inner conductor or dielectric element may protrude outside the outer conductor. The at least one coil spring is also surrounded by the outer conductor. Put differently, the outer conductor forms a compartment in which the inner conductor, the dielectric element(s) and the coil spring(s) are arranged. It is understood that the inner conductor may be either wholly or partly formed by the inner conductor segments. For example, one or more of the coil springs may interconnect inner conductor segments and thus also form part of the inner conductor to form a signal path between an input and an output of the filter. It is furthermore understood that the at least one coil spring is arranged inside said outer conductor to force the inner conductor segment and the at least one dielectric element against an inner surface of the outer conductor. It is furthermore understood that the at least one dielectric element is sandwiched between at least one inner conductor segment and the outer conductor in the sense that it is arranged in abutment with an inner wall portion of the outer conductor and the inner conductor segment. It is furthermore understood that the inner conductor acts as a signal line and the outer conductor as a ground line. It is furthermore understood coil spring in this context refers to a compression spring which may be any type of coil spring for instance a helical coil spring or a coil spring having a non-circular cross section, for instance a substantially square cross section, i.e. a square coil spring. Furthermore, the cross section may be substantially constant along the axial direction of the coil spring, such as in a helical coil spring, or have a non-constant cross-section such as in a volute spring. Furthermore, the wire of the coil spring may have a circular or non-circular cross section.

The invention is based on the insight that a coil can function not only as an inductance both also as a spring, and further that its spring function can be used to force one or more inner conductor segments towards the outer conductor with dielectric element(s) sandwiched therebetween in close abutment with each other and without air gaps due to the spring force. Thereby, accurate capacitances of sufficiently high values can be achieved. Due to the spring action, the tolerances of the outer conductor do not need to be very tight. The filter arrangement is particularly suitable for radio frequency (RF) applications, and in particularly as a low pass filter is used to filter out/block the RF signal to provide a DC voltage and communication signal for an ancillary device. Such a low pass filter may also be referred to as "RF block".

According to a second aspect of the invention, there is provided an antenna feeding network for a multi-radiator antenna, the antenna feeding network comprising at least two elongated outer conductors forming elongated compartments, said at least two elongated outer conductors being formed integrally and in parallel, wherein at least one of the outer conductors is provided with a central inner conductor arranged therein to form at least one substantially air-filled coaxial line. The antenna feeding network comprises a filter arrangement according to the first aspect of the invention or embodiments thereof, wherein the outer electric conductor of the filter arrangement is formed by one of the elongated outer conductors of the antenna feeding network.

According to a third aspect of the invention, there is provided a multi-radiator antenna comprising an antenna feeding network according to the second aspect of the invention or embodiments thereof and radiating elements being connected to the antenna feeding network.

In embodiments, the at least one coil spring is arranged in electrically abutting contact with the at least one inner conductor segment. Thus, a galvanic electric contact is achieved therebetween.

In embodiments, the at least one coil spring is arranged in electrical contact with the at least one inner conductor segment by means of a solder joint.

In alternative embodiments, the at least one coil spring is arranged in electrical contact with the at least one inner conductor segment via at least one electrically conducting connection element. The connection element may for instance be provided a holding portion such as a protrusion extending into the axial centre of the corresponding coil spring.

In embodiments comprising first and second inner conductor segments, a coil spring of the at least one coil spring is arranged to force the first and second inner conductor segments in opposite directions against respective opposite inner wall portions of the outer conductor with a respective dielectric element arranged sandwiched therebetween, wherein the coil spring is electrically connected with the first and second inner conductor segments. The first and second inner conductor segments are thus electrically interconnected by the coil spring and thus together form a C-L-C circuit. One of the first and second inner conductor segments may form, or be connected to an input connector, and the other of the first and second inner conductor segments may form or be connected to an output connector. The filter arrangement thus forms a low pass filter having a C-L-C circuit.

In the above-mentioned embodiment, the first and second inner conductor segments may each be provided with a plate-shaped portion, wherein the plate-shaped portions of the first and second inner conductor segments are arranged facing each other at a distance from each other to form a capacitance therebetween. The plate-shaped portions facing each other are advantageously arranged in parallel with each other to form a well-defined capacitance. The plate-shaped portions are disposed at an angle, preferably at right angle, relative the rest of the respective inner conductor segment. The plate-shaped portions are thus directed inwardly towards the inner wall portions against which the opposite inner conductor segment is forced. The plate-shaped portions may be arranged protruding substantially perpendicularly relative a lengthwise direction of the outer conductor. A dielectric element may be arranged between the plate-shaped portions. The capacitance formed by the plate-shaped portions of the first and second inner conductor segments is electrically in parallel with the inductance formed by the coil spring. By adapting the dimensions of the plate-shaped portions (and optionally the dimensions of the dielectric element therebetween) and the geometric properties (wire thickness, number of turns for example) to each other the capacitance and the inductance may form a resonant circuit providing a transmission zero in the transfer function. This may be advantageous to provide a steeper roll off characteristic of the low pass filter.

In embodiments, the inner electric conductor comprises two consecutively arranged inner conductor segments, each being provided with a plate-shaped portion, wherein the plate-shaped portions are arranged facing each other at a distance from each other to form a capacitance therebetween. In other words, two inner conductor segments are arranged after one another arranged forced (by means of respective coil springs) against the same inner wall portion of the outer conductor with a common, or respective, dielectric element(s) sandwiched therebetween. The plate-shaped portions facing each other are advantageously arranged in parallel with each other to form a well-defined capacitance. The plate-shaped portions are disposed at an angle, preferably at right angle, relative the rest of the respective inner conductor segment. The plate-shaped portions may be arranged protruding substantially perpendicularly relative a lengthwise direction of the outer conductor. A dielectric element may be arranged between the plate-shaped portions. The capacitance formed by the plate-shaped portions interconnect the consecutively arranged inner conductor segments, thus forming a serially arranged capacitance, which may form part of a high-pass or band-pass filter.

In embodiments, the outer conductor has a substantially rectangular or square cross-section in the sense that the cross section it is formed as a parallelogram whose angles are substantially right angles, for example within an interval of 85-95 degrees and/or in the sense that the corners of the rectangle or square are rounded. The at least one inner conductor segment may comprise at least one substantially plate-shaped portion, which each may be arranged in parallel with a plane inner wall portion of the outer conductor. Thereby, a filter arrangement which is easy to manufacture is achieved. The at least one coil spring may be arranged with a lengthwise direction (which may also be referred to as an axial direction) thereof substantially perpendicularly relative a lengthwise direction of the outer conductor. Thereby, a compact filter arrangement is achieved. In embodiments, at least two coil springs are arranged substantially in parallel in said outer conductor.

In embodiments comprising at least two parallel coil springs, a first coil spring and a second coil spring are wound in opposite directions. This may be advantageous since unwanted mutual coupling between the two inductances may be reduced. It is understood that wanted and unwanted mutual coupling between the formed capacitances and inductances can be tuned by altering capacitor and/or coil design.

The features of the embodiments described above are combinable in any practically realizable way to form embodiments having combinations of these features. Further, all features and advantages of embodiments described above with reference to the first aspect of the invention may be applied in corresponding embodiments of the second and third aspects of the invention.

BRIEF DESCRIPTION OF THE DRAWINGS

Above discussed and other aspects of the present invention are described in more detail using the appended drawings, which show preferred embodiments of the invention, wherein.

DETAILED DESCRIPTION

Figure 1A:
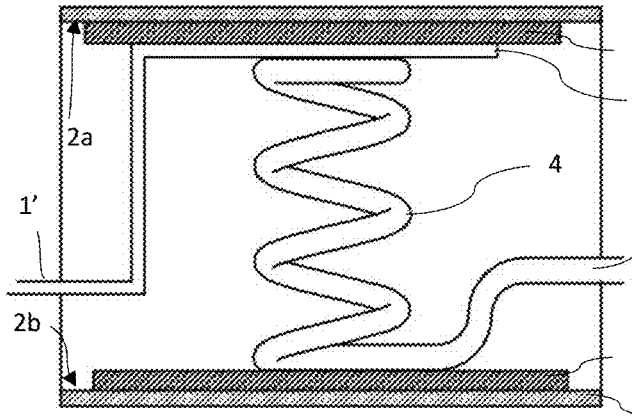
FIG. 1*a* schematically illustrates a first embodiment of a filter arrangement in a cross-sectional view.
Figure 1B:
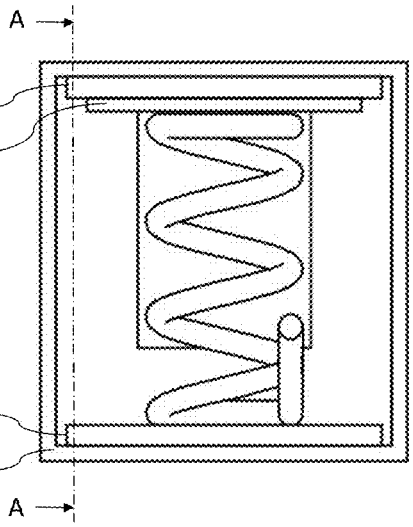
FIG. 1*b* shows a side view of the embodiment in FIG. 1*a,*

FIGS. 1*a* and 1*b* schematically illustrate a first embodiment of the filter arrangement according to the first aspect of the invention. FIG. 1*b* shows a side view of the filter arrangement and FIG. 1*a* is a cross section view taken along the line A-A. An inner electric conductor is formed by an inner conductor segment 1. An outer electric conductor 2 having a rectangular cross section surrounds the inner conductor 1 except for connecting portion 1' which extends out beyond the outer conductor and is configured to provide a signal line input connection to the filter arrangement. In other embodiments, the connecting portion 1' and the wire 5 do not extend outside the outer conductor. This is particularly the case when the filter arrangement is formed as part of an antenna feeding arrangement (see FIG. 5). A first dielectric element 3*a* is arranged sandwiched between the inner conductor segment 1 and an inner wall portion 2*a* of the outer conductor 2 to form a capacitance between the outer conductor 2 and the first inner conductor segment 1. A helical coil spring 4 is arranged inside said outer conductor to force the first inner conductor segment 1 and the first dielectric element 3*a* against the outer conductor. A second dielectric element 3*b* is arranged at the opposite (lower) end of the helical coil spring to electrically insulate the spring from the outer conductor. The helical coil spring is made from an electrically conducting material to form an inductance and is arranged in electrically abutting galvanic contact with the inner conductor segment 1. The inner wall portions 2*a*, 2*b* of the outer conductor 2, the dielectric elements 3*a*, 3*b* and the abutting portion of the inner conductor segment 1 are all plane. An output connection is realized by means of wire 5 forming an extension of the spring 4. In this embodiment, the inner conductor, which may also be referred to the signal line, is formed by the inner conductor segment 1 in series with the spring 4 and wire 5. The output connection may in other embodiments be realized in a different manner, for instance by introducing an additional inner conductor segment identical to the inner conductor segment 1. In such an embodiment, the additional inner conductor will also function as a capacitance to ground.

Figure 1C:
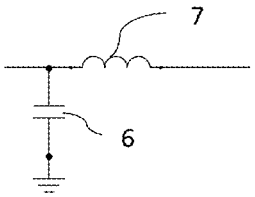
FIG. 1*c* shows an electric schematic illustrating the basic topology implemented by the filter arrangement in FIG. 1*a-b,*

FIG. 1*c* shows an electric schematic illustrating the basic topology implemented by the filter arrangement in FIG. 1*a*. Capacitor 6 corresponds to the capacitance formed by inner conductor segment 1, dielectric element 3*a* and the outer conductor 2. Inductor 7 corresponds to the inductance formed by helical coil spring 4.

Figure 2A:
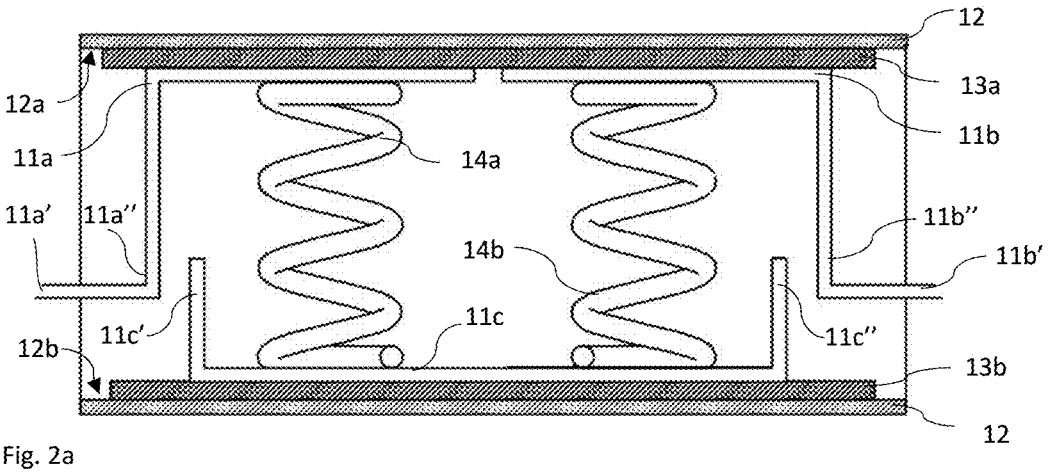
FIG. 2*a* schematically illustrates a second embodiment of a filter arrangement.

FIG. 2*a* schematically illustrates a second embodiment of the filter arrangement according to the first aspect of the invention. FIG. 2*a* is a cross section view in a corresponding manner as in FIG. 1*a*. An inner electric conductor is formed by inner conductor segments 11*a*, 11*b* and 11*c*. An outer electric conductor 12 having a rectangular cross section surrounds the inner conductor segments except for connecting portions 11*a*', 11*b*' which extend out beyond the outer conductor and are configured to provide input/output connections to the filter arrangement. A first dielectric element 13*a* is arranged sandwiched between the first inner conductor segment 11*a* and an upper inner wall portion 12*a* of the outer conductor 12 to form a capacitance between the outer conductor 12 and the first inner conductor segment 11*a*. The first dielectric element 13*a* is also arranged sandwiched between the second inner conductor segment 11*b* and the upper inner wall portion 12*a* of the outer conductor 12 to form a capacitance between the outer conductor 12 and the second inner conductor segment 11*b*. A second dielectric element 13*b* is arranged sandwiched between the third inner conductor segment 11*c* and a lower inner wall portion 12*b* of the outer conductor 12 to form a capacitance between the outer conductor 12 and the third inner conductor segment 11*c*. Helical coil springs 14*a*, 14*b* are arranged in parallel inside the outer conductor perpendicular to a lengthwise direction of the outer conductor 12, i.e., perpendicular to the inner wall portions 12*a-b*. In order to minimize feedback between the inductances formed by the helical coil springs, they are arranged at a distance from each other in the lengthwise direction and are also, as can be seen in FIG. 2*a*, wound in opposite directions. Spring 14*a* forces the first inner conductor segment 11*a* and the first dielectric element 13*a* upwards against the upper inner wall portion of the outer conductor. Spring 14*b* forces the second inner conductor segment 11*b* and the first dielectric element 13*a* upwards against the upper inner wall portion of the outer conductor. Both springs 14*a*, 14*b* force the third inner conductor segment 11*c* and the second dielectric element 13*b* downwards against the lower inner wall portion of the outer conductor. The inner wall portions 12*a-b* of the outer conductor, the dielectric elements 13*a-b* and the portion of the inner conductor segments 11*a-c* in abutment therewith are all plane. The helical coil springs 14*a-b* are made from an electrically conducting material to form inductances and are arranged in electrically abutting galvanic contact with the respective inner conductor segments.

The first and second inner conductor segments 11*a*, 11*b* are each provided with a plate-shaped downwardly perpendicularly protruding portion 11*a*", 11*b*". The third inner conductor segment 11*c* is provided with plate-shaped upwardly perpendicularly protruding portion 11*c*', 11*c*' at the opposite lengthwise ends thereof. Plate-shaped portion 11*a*" and plate-shaped portion 11*c*' are arranged at a distance from each other to form a capacitance therebetween which is electrically in parallel with the inductance formed by the helical coil spring 14*a*. Plate-shaped portion 11*b*" and plate-shaped portion 11*c*" are arranged at a distance from each other to form a capacitance therebetween which is electrically in parallel with the inductance formed by the helical coil spring 14*b*. In other embodiments, dielectric element(s) may be arranged between the plate-shaped portions.

Figure 2B:
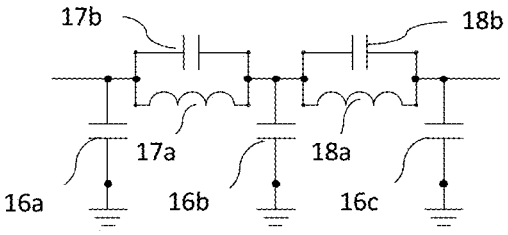
FIG. 2*b* shows an electric schematic illustrating the basic topology implemented by the filter arrangement in FIG. 2*a,*

FIG. 2*b* shows an electric schematic illustrating the basic topology implemented by the filter arrangement in FIG. 2*a*. Capacitor 16*a* corresponds to the capacitance formed by the first inner conductor segment 11*a*, dielectric element 13*a* and the outer conductor 12. Inductor 17*a* corresponds to the inductance formed by helical coil spring 14*a* and capacitor 17*b* corresponds to the capacitance formed by plate-shaped portions 11*a*" and 11*c*'. Inductor 17*a* and capacitor 17*b* forms a resonant circuit. Capacitor 16*b* corresponds to the capacitance formed by the third inner conductor segment 11*c*, dielectric element 13*b* and the outer conductor 12. Inductor 18*a* corresponds to the inductance formed by helical coil spring 14*b* and capacitor 18*b* corresponds to the capacitance formed by plate-shaped portions 11*b*" and 11*c*".

Inductor 18*a* and capacitor 18*b* forms a resonant circuit. Capacitor 16*c* corresponds to the capacitance formed by the second inner conductor segment 11*b*, dielectric element 13*a* and the outer conductor 12. As can be seen, the resulting topology is a low-pass filter. Transmission zeros are present due to the resonant circuits 17*a*/17*b* and 18*a*/18*b*.

Figure 3A:
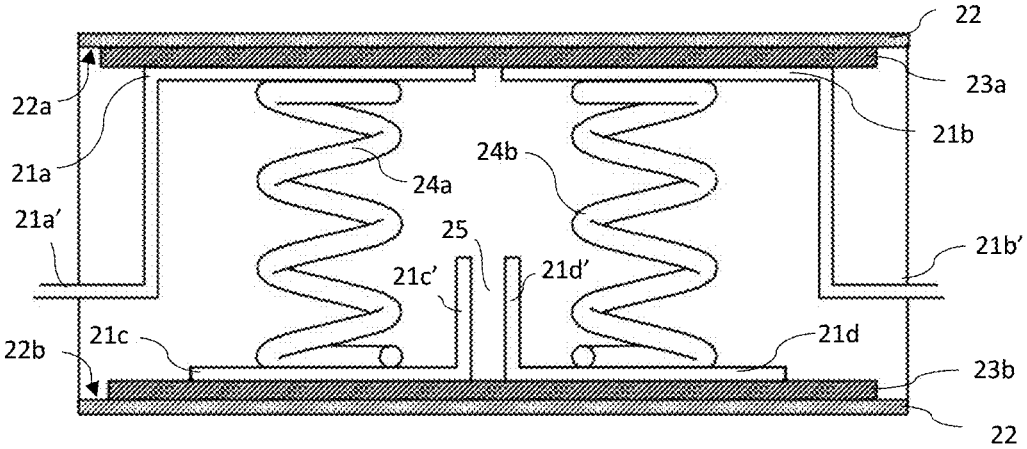
FIG. 3*a* schematically illustrates a third embodiment of a filter arrangement.

FIG. 3*a* schematically illustrates a third embodiment of the filter arrangement according to the first aspect of the invention. This embodiment corresponds to the embodiment in FIG. 2*a* in the sense that it comprises an outer conductor 22, first/second dielectric elements 23*a*/23*b*, helical coil springs 24*a*/24*b*, and first and second inner conductor segments 21*a*/21*b* with connecting portions 21*a*'/21*b*' being identical to the corresponding features in FIG. 2*a*.

The embodiment in FIG. 3*a* however differs in that it comprises a third inner conductor segment 21*c* forced downwardly towards the dielectric element 23*b* by the spring 24*a*, and a fourth inner conductor segment 21*d* forced downwardly towards the dielectric element 23*b* by the spring 24*b*. The third and fourth inner conductor segments 21*c*, 21*d* are each provided with a plate-shaped upwardly perpendicularly protruding portion 21*c*', 21*d*'. Plate-shaped portion 21*c*' and plate-shaped portion 21*d*' are arranged at a distance from each other with a space 25 therebetween to form a capacitance therebetween. Optionally, a dielectric element therebetween may be arranged at 25.

Figure 3B:
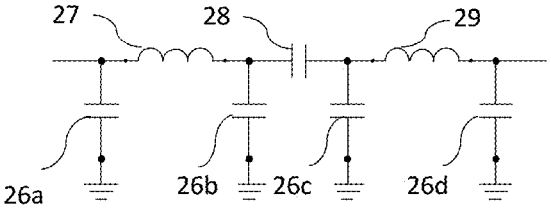
FIG. 3*b* shows an electric schematic illustrating the basic topology implemented by the filter arrangement in FIG. 3*a*, FIG. 4*a* schematically illustrates a fourth embodiment of the filter arrangement.

FIG. 3*b* shows an electric schematic illustrating the basic topology implemented by the filter arrangement in FIG. 3*a*. Capacitor 26*a* corresponds to the capacitance formed by the first inner conductor segment 21*a*, dielectric element 23*a* and the outer conductor 22. Inductor 27 corresponds to the inductance formed by helical coil spring 24*a*. Capacitor 26*b* corresponds to the capacitance formed by the third inner conductor segment 21*c*, dielectric element 23*b* and the outer conductor 22. Capacitor 28 corresponds to the capacitance formed between plate-shaped portions 21*c*' and 21*d*'. Inductor 29 corresponds to the inductance formed by helical coil spring 24*b*. Capacitor 26*c* corresponds to the capacitance formed by the fourth inner conductor segment 21*d*, dielectric element 23*b* and the outer conductor 22. Capacitor 26*d* corresponds to the capacitance formed by the second inner conductor segment 21*b*, dielectric element 23*a* and the outer conductor 22. As can be seen, the resulting topology is a band-pass filter.

Figure 4A:
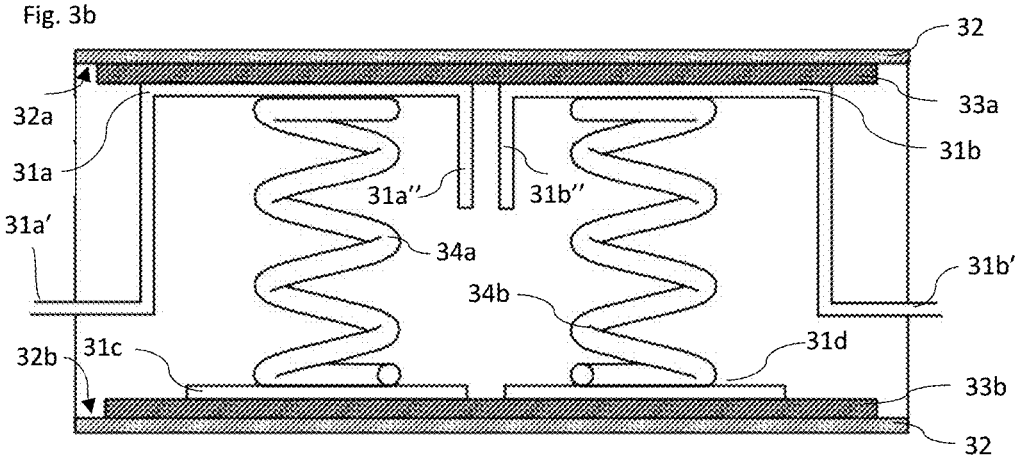
FIG. 4*b* shows an electric schematic illustrating the basic topology implemented by the filter arrangement in FIG. 4*a*, and FIG. 5 schematically illustrates an embodiment of a multi-radiator antenna, which comprises an embodiment of the antenna feeding network having a filter arrangement.

FIG. 4*a* schematically illustrates a fourth embodiment of the filter arrangement according to the first aspect of the invention. FIG. 4*a* is a cross section view in a corresponding manner as in FIG. 1*a*. An inner electric conductor is formed by inner conductor segments 31*a*, 31*b*, 31*c* and 31*d*. An outer electric conductor 32 having a rectangular cross section surrounds the inner conductor segments except for connecting portions 31*a*', 31*b*' which extend out beyond the outer conductor and are configured to provide input/output connections to the filter arrangement. A first dielectric element 33*a* is arranged sandwiched between the first inner conductor segment 31*a* and an upper inner wall portion 32*a* of the outer conductor 32 to form a capacitance between the outer conductor 32 and the first inner conductor segment 31*a*. The first dielectric element 33*a* is also arranged sandwiched between the second inner conductor segment 31*b* and the upper inner wall portion 32*a* of the outer conductor 32 to form a capacitance between the outer conductor 32 and the second inner conductor segment 31*b*. A second dielectric element 33*b* is arranged sandwiched between the third and fourth inner conductor segment 31*c* and 31*d* and a lower inner wall portion 32*b* of the outer conductor 32 to form capacitances between the outer conductor 32 and the third/fourth inner conductor segment 31*c*, 31*d*. Helical coil springs 34*a*, 34*b* are arranged in parallel inside the outer conductor perpendicular to a lengthwise direction of the outer conductor 32, i.e. perpendicular to the inner wall portions 32*a-b*. Spring 34*a* forces the first inner conductor segment 31*a* and the first dielectric element 33*a* upwards against the upper inner wall portion of the outer conductor. Spring 34*b* forces the second inner conductor segment 31*b* and the first dielectric element 33*a* upwards against the upper inner wall portion of the outer conductor.

The first and second inner conductor segments 31*a*, 31*b* are each provided with a plate-shaped downwardly perpendicularly protruding portion 31*a*", 31*b*". Plate-shaped portion 31*a*" and plate-shaped portion 31*b*" are arranged at a distance from each other (optionally with a dielectric element therebetween) to form a capacitance therebetween. The third inner conductor segment 31*c* is forced downwardly towards the dielectric element 33*b* by the spring 34*a*, and the fourth inner conductor segment 31*d* forced downwardly towards the dielectric element 33*b* by the spring 34*b*. The helical coil springs 14*a-b* are made from an electrically conducting material to form inductances and are arranged in electrically abutting galvanic contact with the respective inner conductor segments.

Figure 4B:
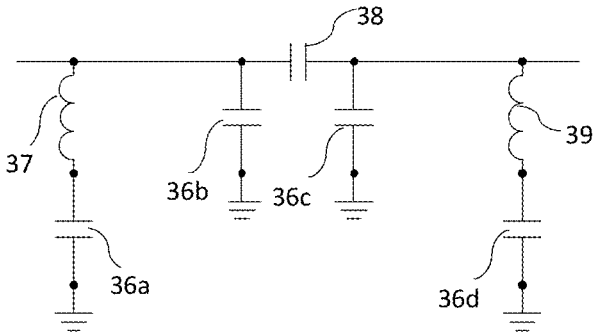

FIG. 4*b* shows an electric schematic illustrating the basic topology implemented by the filter arrangement in FIG. 4*a*. Capacitor 36*a* corresponds to the capacitance formed by the third inner conductor segment 31*c*, dielectric element 33*b* and the outer conductor 32. Inductor 37 corresponds to the inductance formed by helical coil spring 34*a*. Capacitor 36*b* corresponds to the capacitance formed by the first inner conductor segment 31*a*, dielectric element 33*a* and the outer conductor 32. Capacitor 38 corresponds to the capacitance formed between plate-shaped portions 31*a*" and 31*b*". Capacitor 36*c* corresponds to the capacitance formed by the second inner conductor segment 31*b*, dielectric element 33*a* and the outer conductor 32.

Capacitor 36*d* corresponds to the capacitance formed by the fourth inner conductor segment 31*d*, dielectric element 33*b* and the outer conductor 32. Inductor 39 corresponds to the inductance formed by helical coil spring 34*b*. As can be seen, the resulting topology is a high-pass filter. Transmission zeros are present due to the resonant circuits 36*a*/37 and 36*d*/39.

Figure 5:
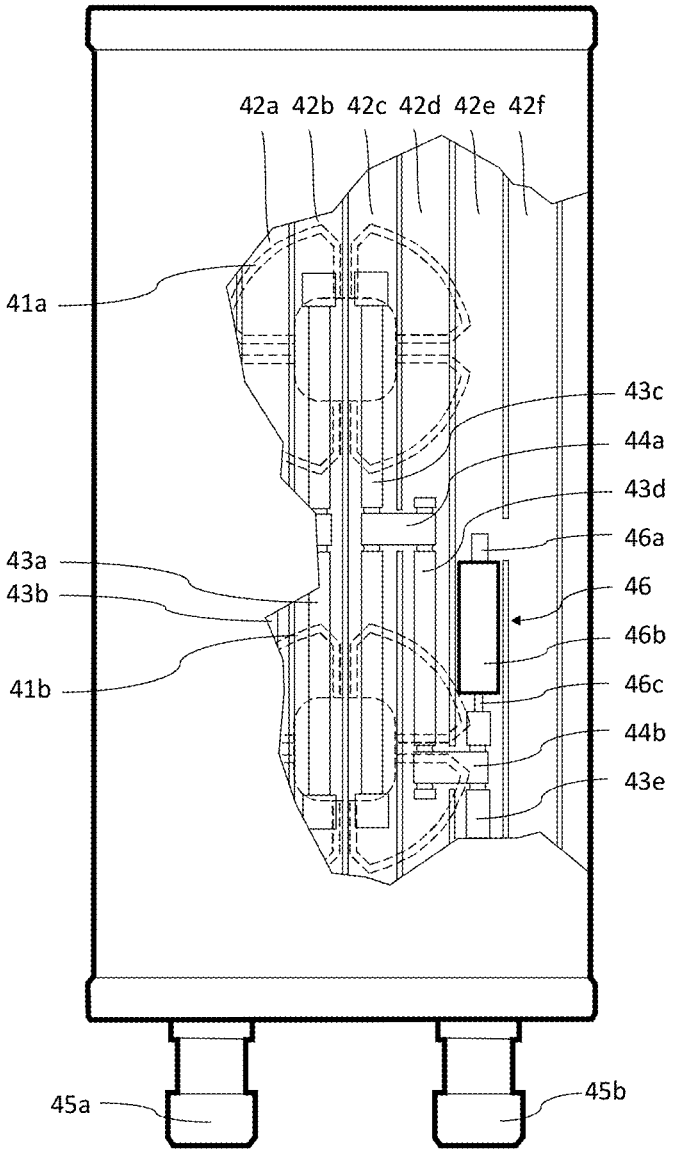

FIG. 5 schematically illustrates an antenna feeding network according to a second aspect of the invention and an embodiment of the multi-radiator antenna according to a third aspect of the invention, which comprises an embodiment of the antenna feeding network according to the second aspect of the invention. The multi-radiator antenna comprises an antenna feeding network and radiating elements 41*a*, 41*b* being connected to the antenna feeding network. The multi-radiator antenna is seen from behind the antenna feeding network/reflector in a partial cut-away view. The antenna feeding network is of the same type as disclosed in US2019051960A1 (which is hereby incorporated by reference), except for the addition of a filter arrangement according to the first aspect of the present invention. In this embodiment, the antenna feeding network comprises eight outer conductors (six are visible in FIG. 5, ref. 42*a-f*), each forming an elongated compartment. The elongated outer conductors are formed integrally and in parallel in the form of an extruded aluminium profile which also functions as a reflector. As can be seen in FIG. 5, each of the outer conductors 42*a-e* is provided with a respective central inner conductor 43*a-e* arranged therein to form substantially air-filled coaxial lines. Inner conductor 43*e* is connected at its first end to coaxial connector 45*b*, and at its second end to a filter arrangement 46. In the vicinity of the second end, a connector device 44*b* connects the inner conductor 43*e* to inner conductor 43*d* which in turn is connected to a middle portion of inner conductor 43*c* to split/combine the signal to/from both radiating elements 41*a*, 41*b*.

The filter arrangement 46 is a low pass filter of the same type shown in FIG. 2*a*. The inner conductor 43*e* connects to connecting portion 46*c* (corresponding to 11*a*' in FIG. 2*a*) of the filter arrangement. The outer electric conductor of the filter arrangement is formed by the outer conductor 42*e* of the antenna feeding network. The dielectric element 46*b* corresponds to ref. 13*a* in FIG. 2*a*. The connecting portions 46*a* corresponds to ref. 11*b*' in FIG. 2*a*. In other embodiments, the filter arrangement 46 may be a band pass filter for instance as shown in FIG. 3*a*. The low/band pass filter is configured to filter out/block the RF signal to provide DC voltage and communication signal for a RET (Remove Electrical Tilt) motor (not shown) which is connectable to connecting portion 46*a*.

It is understood that inner conductors 43*a*, 43*b* and the inner conductor in the not visible outer conductor to the left of outer conductor 42*a* are interconnected with corresponding connector devices as outer conductors 42*c*-*e* and are connected in a corresponding manner to coaxial connector 45*a*, but without a filter arrangement as in outer conductor 42*e*.

The description above and the appended drawings are to be considered as non-limiting examples of the invention. The person skilled in the art realizes that several changes and modifications may be made within the scope of the invention. In particular, it is pointed out that higher or lower order filter arrangements than the above illustrated embodiments may be achieved by adding or removing inner conductor segments and/or helical coil springs and/or by combining features of the illustrated embodiments. Furthermore, the number of coaxial lines may be varied, and the number of radiators/dipoles may be varied.

The invention claimed is:

1. A filter arrangement comprising:

an inner electric conductor comprising at least one inner conductor segment;

an outer electric conductor at least partly surrounding the inner electric conductor; —at least one dielectric element arranged sandwiched between the at least one inner conductor segment and the outer conductor to form a capacitance between the outer conductor and the at least one inner conductor segment; —at least one coil spring arranged inside said outer conductor to force the at least one inner conductor segment and the at least one dielectric element against the outer conductor, wherein said at least one coil spring is made from an electrically conducting material to form an inductance, and wherein said at least one coil spring is electrically connected with said at least one inner conductor segment.

2. The filter arrangement according to claim 1, wherein said at least one coil spring is arranged in electrically abutting contact with the at least one inner conductor segment.

3. The filter arrangement according to claim 1, wherein the inner electric conductor comprises two consecutively arranged inner conductor segments, each being provided with a plate-shaped portion, wherein the plate-shaped portions are arranged facing each other at a distance from each other to form a capacitance therebetween.

4. The filter arrangement according to claim 1, wherein said outer conductor has a substantially rectangular cross-section, and wherein said at least one inner conductor segment comprise at least one substantially plane portion.

5. The filter arrangement according to claim 1, wherein said at least one coil spring is arranged with a lengthwise direction thereof substantially perpendicularly relative a lengthwise direction of the outer conductor.

6. The filter arrangement according to claim 1, comprising at least two of the at least one coil springs arranged substantially in parallel in said outer conductor.

7. The filter arrangement according to claim 1, wherein the at least one coil spring comprising first and second coil springs arranged in parallel inside the outer conductor, wherein said inner electric conductor comprises first, second and third inner conductor segments, the first and second inner conductor segments being consecutively arranged, wherein said first coil spring is arranged to force the first inner conductor segment against an upper portion of the outer conductor with a first dielectric element of the at least one dielectric element sandwiched therebetween, wherein said second coil spring is arranged to force the second inner conductor segment against an upper portion of the outer conductor with a second dielectric element of the at least one dielectric element sandwiched therebetween, wherein the first and second coil springs are arranged to force the third inner conductor segment against a lower portion of the outer conductor with a third dielectric element of the at least one dielectric element sandwiched therebetween wherein the first coil spring is electrically connected with the first and third inner conductor segments, and the second coil spring is electrically connected with the second and third inner conductor segments.

8. The filter arrangement according to claim 1, wherein the at least one coil spring comprising first and second coil springs arranged in parallel inside the outer conductor, wherein the first and second coil springs are wound in opposite directions.

9. The filter arrangement according to claim 1, wherein the at least one inner conductor segment comprising first and second inner conductor segments, wherein a coil spring of the at least one coil spring is arranged to force the first and second inner conductor segments in opposite directions against respective inner wall portions of the outer conductor with a respective one of the at least one dielectric element arranged sandwiched therebetween, wherein said coil spring is electrically connected with the first and second inner conductor segments.

10. The filter arrangement according to claim 9, wherein each of the first and second inner conductor segments is provided with a plate-shaped portion, wherein the plate-shaped portions of the first and second inner conductor segments are arranged facing each other at a distance from each other to form a capacitance therebetween.

11. The filter arrangement according to claim 10, comprising one of the at least one dielectric element arranged between said plate-shaped portions.

12. The filter arrangement according to claim 10, wherein said plate-shaped portions are formed substantially perpendicularly relative a lengthwise direction of the outer conductor.

13. An antenna feeding network for a multi-radiator antenna, the antenna feeding network comprising at least two elongated outer conductors forming elongated compartments, said at least two elongated outer conductors being formed integrally and in parallel, wherein at least one of the outer conductors is provided with a central inner conductor arranged therein to form at least one substantially air-filled coaxial line, wherein the antenna feeding network comprises a filter arrangement comprising:

an inner electric conductor comprising at least one inner conductor segment;

an outer electric conductor at least partly surrounding the inner electric conductor; —at least one dielectric element arranged sandwiched between at least one inner conductor segment and the outer conductor to form a capacitance between the outer conductor and the at least one inner conductor segment; —at least one coil spring arranged inside said outer conductor to force the at least one inner conductor segment and the at least one dielectric element against the outer conductor, wherein said at least one coil spring is made from an electrically conducting material to form an inductance, and wherein said at least one coil spring is electrically connected with said at least one inner conductor segment, wherein the outer electric conductor of the filter arrangement is formed by one of the elongated outer conductors of the antenna feeding network.

14. The antenna feeding network according to claim 13, wherein the inner electric conductor of the filter arrangement is connected to at least one central inner conductor of the at least one coaxial line.

15. The antenna feeding network according to claim 13, wherein the at least one inner conductor segment comprising first and second inner conductor segments, wherein a coil spring of the at least one coil spring is arranged to force the first and second inner conductor segments in opposite directions against respective inner wall portions of the outer conductor with a respective one of the at least one dielectric element arranged sandwiched therebetween, wherein said coil spring is electrically connected with the first and second inner conductor segments.

16. The antenna feeding network according to claim 15, wherein each of the first and second inner conductor segments is provided with a plate-shaped portion, wherein the plate-shaped portions of the first and second inner conductor segments are arranged facing each other at a distance from each other to form a capacitance therebetween.

17. The antenna feeding network according to claim 13, wherein the inner electric conductor comprises two consecutively arranged inner conductor segments, each being provided with a plate-shaped portion, wherein the plate-shaped portions are arranged facing each other at a distance from each other to form a capacitance therebetween.

18. A multi-radiator antenna comprising an antenna feeding network and radiating elements being connected to the antenna feeding network, said antenna feeding network comprising at least two elongated outer conductors forming elongated compartments, said at least two elongated outer conductors being formed integrally and in parallel, wherein at least one of the outer conductors is provided with a central inner conductor arranged therein to form at least one substantially air-filled coaxial line, wherein the antenna feeding network comprises a filter arrangement comprising:

an inner electric conductor comprising at least one inner conductor segment;

an outer electric conductor at least partly surrounding the inner electric conductor; —at least one dielectric element arranged sandwiched between at least one inner conductor segment and the outer conductor to form a capacitance between the outer conductor and the at least one inner conductor segment; —at least one coil spring arranged inside said outer conductor to force the at least one inner conductor segment and the at least one dielectric element against the outer conductor, wherein said at least one coil spring is made from an electrically conducting material to form an inductance, and wherein said at least one coil spring is electrically connected with said at least one inner conductor segment, wherein the outer electric conductor of the filter arrangement is formed by one of the elongated outer conductors of the antenna feeding network.

19. The multi-radiator antenna according to claim 18, wherein the at least one inner conductor segment comprising first and second inner conductor segments, wherein a coil spring of the at least one coil spring is arranged to force the first and second inner conductor segments in opposite directions against respective inner wall portions of the outer conductor with a respective one of the at least one dielectric element arranged sandwiched therebetween, wherein said coil spring is electrically connected with the first and second inner conductor segments.

20. The multi-radiator antenna according to claim 19, wherein each of the first and second inner conductor segments is provided with a plate-shaped portion, wherein the plate-shaped portions of the first and second inner conductor segments are arranged facing each other at a distance from each other to form a capacitance therebetween.

21. The multi-radiator antenna according to claim 18, wherein the inner electric conductor comprises two consecutively arranged inner conductor segments, each being provided with a plate-shaped portion, wherein the plate-shaped portions are arranged facing each other at a distance from each other to form a capacitance therebetween.

* * * * *